US010520158B2

(12) United States Patent
Yamamoto

(10) Patent No.: US 10,520,158 B2
(45) Date of Patent: Dec. 31, 2019

(54) ARRANGEMENT OF PLURAL LIGHT EMITTING CHIPS IN A VEHICLE LAMP

(71) Applicant: KOITO MANUFACTURING CO., LTD., Tokyo (JP)

(72) Inventor: Ippei Yamamoto, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 235 days.

(21) Appl. No.: 15/693,737

(22) Filed: Sep. 1, 2017

(65) Prior Publication Data

US 2018/0066820 A1 Mar. 8, 2018

(30) Foreign Application Priority Data

Sep. 2, 2016 (JP) ..... 2016-171499

(51) Int. Cl.

| | |
|---|---|
| ***F21S 41/151*** | (2018.01) |
| ***F21S 41/147*** | (2018.01) |
| ***F21S 41/33*** | (2018.01) |
| ***F21S 41/27*** | (2018.01) |

(52) U.S. Cl.

CPC ..... *F21S 41/335* (2018.01); *F21S 41/147* (2018.01); *F21S 41/151* (2018.01); *F21S 41/27* (2018.01)

(58) Field of Classification Search

CPC ..... F21S 41/147; F21S 41/148; F21S 41/151; F21S 41/153; F21S 41/335; F21S 41/27; F21S 41/255; F21Y 2103/10; F21W 2102/13

See application file for complete search history.

(56) References Cited

U.S. PATENT DOCUMENTS

| | | | | |
|---|---|---|---|---|
| 2008/0239740 | A1* | 10/2008 | Nakada | F21S 41/147 362/507 |
| 2010/0033985 | A1 | 2/2010 | Hsu et al. | |
| 2013/0294101 | A1 | 11/2013 | Brendle | |
| 2014/0293634 | A1 | 10/2014 | Nakada | |

FOREIGN PATENT DOCUMENTS

| | | | |
|---|---|---|---|
| EP | 1 681 509 | A1 | 7/2006 |
| FR | 3 009 367 | A1 | 2/2015 |
| JP | 2014-203513 | A | 10/2014 |
| WO | 2011/135506 | A1 | 11/2011 |

OTHER PUBLICATIONS

Communication dated Aug. 8, 2019, issued by the French Patent Office in counterpart France Application No. FR1758082.

* cited by examiner

*Primary Examiner* — Suezu Ellis
(74) *Attorney, Agent, or Firm* — Sughrue Mion, PLLC

(57) ABSTRACT

A vehicle lamp includes a projection lens, a first light emitting chip and a second light emitting chip disposed on left and right sides, and a reflector which reflects light toward the projection lens. The reflector includes a reflecting surface which includes a left rear area, a right rear area, a left front area, and a right front area. The left rear area and the right front area reflect light emitted from the first light emitting chip to converge to a rear focal point of the projection lens at a higher convergence degree than light emitted from the second light emitting chip. The right rear area and the left front area reflect light emitted from the second light emitting chip to converge to the rear focal point of the projection lens at a higher convergence degree than light emitted from the first light emitting chip.

4 Claims, 7 Drawing Sheets

ARRANGEMENT OF PLURAL LIGHT EMITTING CHIPS IN A VEHICLE LAMP

CROSS-REFERENCE TO RELATED APPLICATIONS

The present application claims the benefit of priority of Japanese Patent Application No. 2016-171499, filed on Sep. 2, 2016, the content of which is incorporated herein by reference.

TECHNICAL FIELD

The present invention relates to a projector-type vehicle lamp including a reflector.

BACKGROUND

There is known a projector-type vehicle lamp which is configured to reflect light toward a projection lens from a light source disposed on a rear side of a rear focal point of the projection lens by a reflector.

JP-A-2014-203513 discloses such a vehicle lamp which includes a light emitting diode having a horizontally elongated rectangular light emitting surface, as a light source.

In the vehicle lamp disclosed in JP-A-2014-203513, since the light emitting diode has a light emitting surface having a horizontally elongated rectangular shape, a horizontally elongated light distribution pattern can be easily formed.

However, in such a vehicle lamp, when a horizontally elongated spot-shaped light distribution pattern is formed in order to enhance long-distance visibility, the following problems might occur.

That is, when a light emitting diode arrangement is adopted in which a pair of left and right light emitting chips are provided to form a horizontally elongated rectangular light emitting surface, a gap is formed between the two light emitting chips. Due to the gap, a dark area is formed at a center position in a lateral direction in the horizontally elongated spot-shaped light distribution pattern. Further, each light emitting chip has a luminance distribution in which luminance sharply decreases at an outer peripheral edge portion of the light emitting chip. Accordingly, even due to this luminance distribution, the horizontally elongated spot-shaped light distribution pattern becomes dark in the center position in the lateral direction. Consequently, it might be difficult to improve long-distance visibility.

SUMMARY

The present invention has been made in view of the above circumstances, and an aspect of the present invention provides a projector-type vehicle lamp including a reflector which can form a horizontally elongated spot-shaped light distribution pattern with excellent long-distance visibility.

An aspect of present invention modifies the configuration of the reflector.

According to an illustrative embodiment of the present invention, there is provided a vehicle lamp including a projection lens, a light emitting diode disposed on a rear side of a rear focal point of the projection lens, and a reflector configured to reflect light emitted from the light emitting diode toward the projection lens. The light emitting diode includes a first light emitting chip disposed on a left side with respect to an optical axis of the projection lens, and a second light emitting chip disposed on a right side with respect to the optical axis of the projection lens. The reflector includes a reflecting surface which includes a left rear area located on a left side of the optical axis and a rear side of the first and second light emitting chips, a right rear area located on a right side of the optical axis and the rear side of the first and second light emitting chips, a left front area located on the left side of the optical axis and a front side of the first and second light emitting chips, and a right front area located on the right side of the optical axis and the front side of the first and second light emitting chips. The left rear area and the right front area have reflecting surface shapes which are configured to reflect light emitted from the first light emitting chip to converge to the rear focal point of the projection lens at a higher convergence degree than light emitted from the second light emitting chip. The right rear area and the left front area have reflecting surface shapes which are configured to reflect light emitted from the second light emitting chip to converge to the rear focal point of the projection lens at a higher convergence degree than light emitted from the first light emitting chip.

Herein, as long as the "light emitting diode" is disposed on the rear side of the rear focal point of the projection lens, specific configurations such as the shape and direction of the light emitting surface of the first and second light emitting chips are not particularly limited.

As long as the "left rear area" and the "right rear area" are located on the rear side of the first and second light emitting chips, the specific formation range thereof is not particularly limited.

As long as the "front left area" and the "front right area" are located on the front side of the first and second light emitting chips, the specific formation range thereof is not particularly limited.

As long as the "left rear area" and "right front area" have reflecting surface shapes which are configured to reflect the light emitted from the first light emitting chip to converge to the rear focal point of the projection lens at a higher convergence degree than the light emitted from the second light emitting chip, the specific reflecting surface shape thereof is not particularly limited.

As long as the "right rear area" and the "left front area" have reflecting surface shapes which are configured to reflect the light emitted from the second light emitting chip to converge to the rear focal point of the projection lens at a higher convergence degree than the light emitted from the first light emitting chip, the specific reflecting surface shape thereof is not particularly limited.

According to the above configuration, the vehicle lamp is configured as a projector-type vehicle lamp which includes the light emitting diode having the pair of first (left) and second (right) emitting chips and the reflector, so that a horizontally elongated spot-shaped light distribution pattern can be easily formed.

Further, the reflecting surface of the reflector includes the left rear area and the right rear area located on the rear side of the first and second light emitting chips, the left front area and the right front area located on the front side of the first and second light emitting chips. The left rear area and the right front area have reflecting surface shapes which are configured to reflect light emitted from the first light emitting chip disposed on the left side converge to the rear focal point of the projection lens at a higher convergence degree than light emitted from the second light emitting chip disposed on the right side. The right rear area and the left front area have reflecting surface shapes which are configure to reflect light emitted from the second light emitting chip to converge to the rear focal point of the projection lens at a higher convergence degree than light emitted from the first light emitting chip. Accordingly, the following operation and effect can be obtained.

That is, since a projection image of the first light emitting chip is formed at a position in front of the lamp by the reflected light from the left rear area and the right front area, a projection image of the second light emitting chip is formed at a position in front of the lamp by the reflected light from the right rear area and the left front area, it is possible to form the horizontally elongated spot-shaped light distribution pattern as a light distribution pattern whose center position in the lateral direction is bright. Therefore, long-distance visibility can be improved.

In the meantime, the reflected light from the left rear area forms the projection image of the second light emitting chip on the right side of the projection image of the first light emitting chip, the reflected light from the right front area forms the projection image of the second light emitting chip on the left side of the projection image of the first light emitting chip, the reflected light from the right rear area forms the projection image of the first light emitting chip on the left side of the projection image of the second light emitting chip, and the reflected light from the left front area forms the projection image of the first light emitting chip on the right side of the projection image of the second light emitting chip. Therefore, a horizontally elongated spot-shaped light distribution pattern can be formed in which the brightness gradually decreases toward the left and right sides.

As described above, according to the above configuration, in a projector-type vehicle lamp including a reflector, a horizontally elongated spot-shaped light distribution pattern can be formed with excellent long-distance visibility.

In the above configuration, the left rear area and the right front area may have the reflecting surface shapes substantially along an elliptical surface with a light emitting center of the first light emitting chip as a first focal point and the rear focal point of the projection lens as a second focal point, and the right rear area and the left front area may have the reflecting surface shapes substantially along an elliptical surface with a light emitting center of the second light emitting chip as a first focal point and the rear focal point of the projection lens as a second focal point. In this case, a horizontally elongated spot-shaped light distribution pattern can be formed as a light distribution pattern whose center position in the lateral direction is highly bright, so that long-distance visibility can be further improved.

In the above configuration, in the reflecting surface of the reflector, the left rear area and the left front area may be continuously formed, and the right rear area and the right front area may be continuously formed. In this case, utilization efficiency of the light emitted from the first and the second light emitting chips can be improved.

In the above configuration, at least one additional light emitting chip may be respectively disposed on a left side and a right side of the first and second light emitting chips. In this case, the horizontally elongated spot-shaped light distribution pattern can be further expanded to the left and right sides and a horizontal elongated light distribution pattern which is smoother in intensity can be formed.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Hereinafter, embodiments of the present invention will be described with reference to the drawings.

Figure 1:
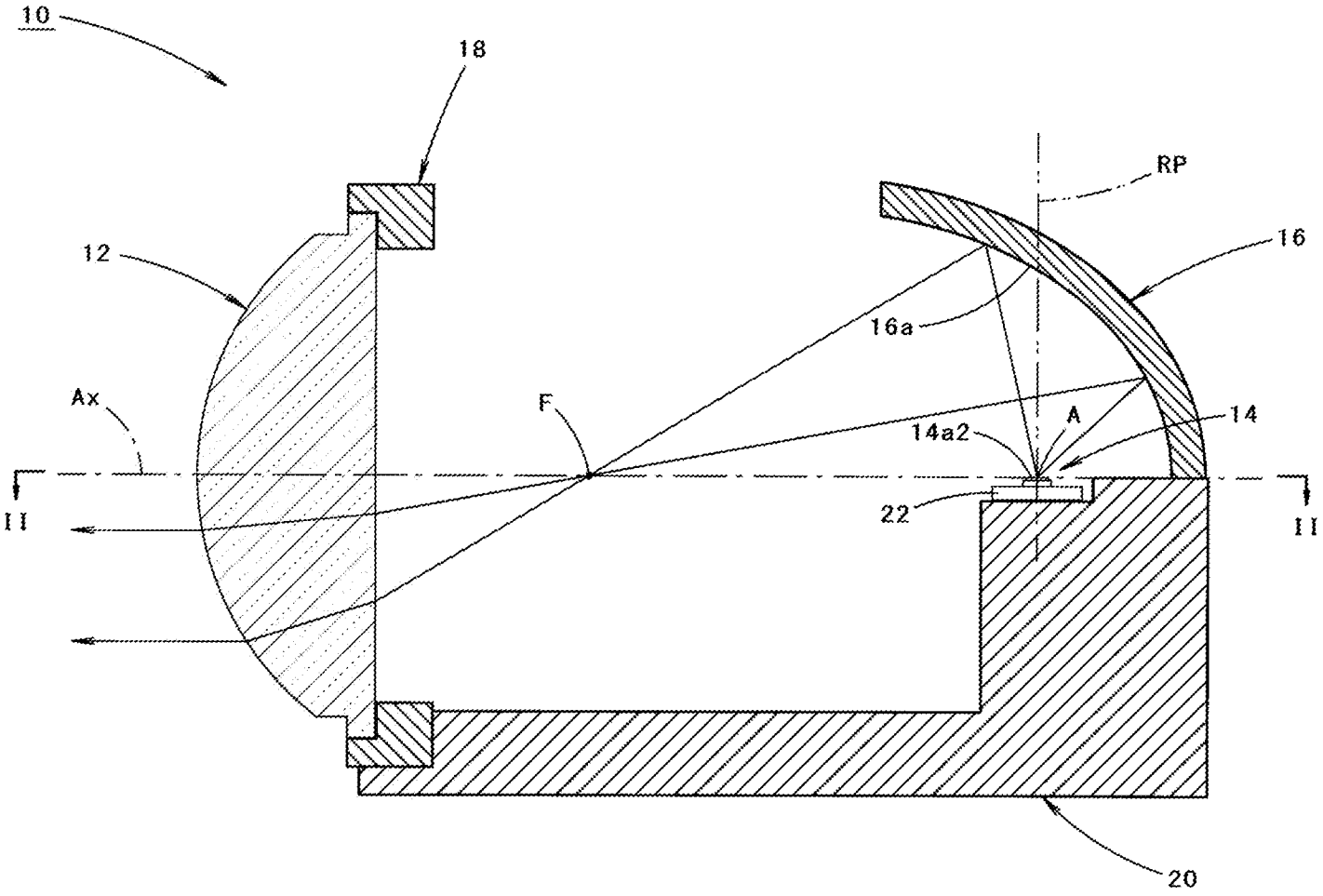
FIG. 1 is a cross-sectional view showing a vehicle lamp according to an embodiment of the present invention.
Figure 2:
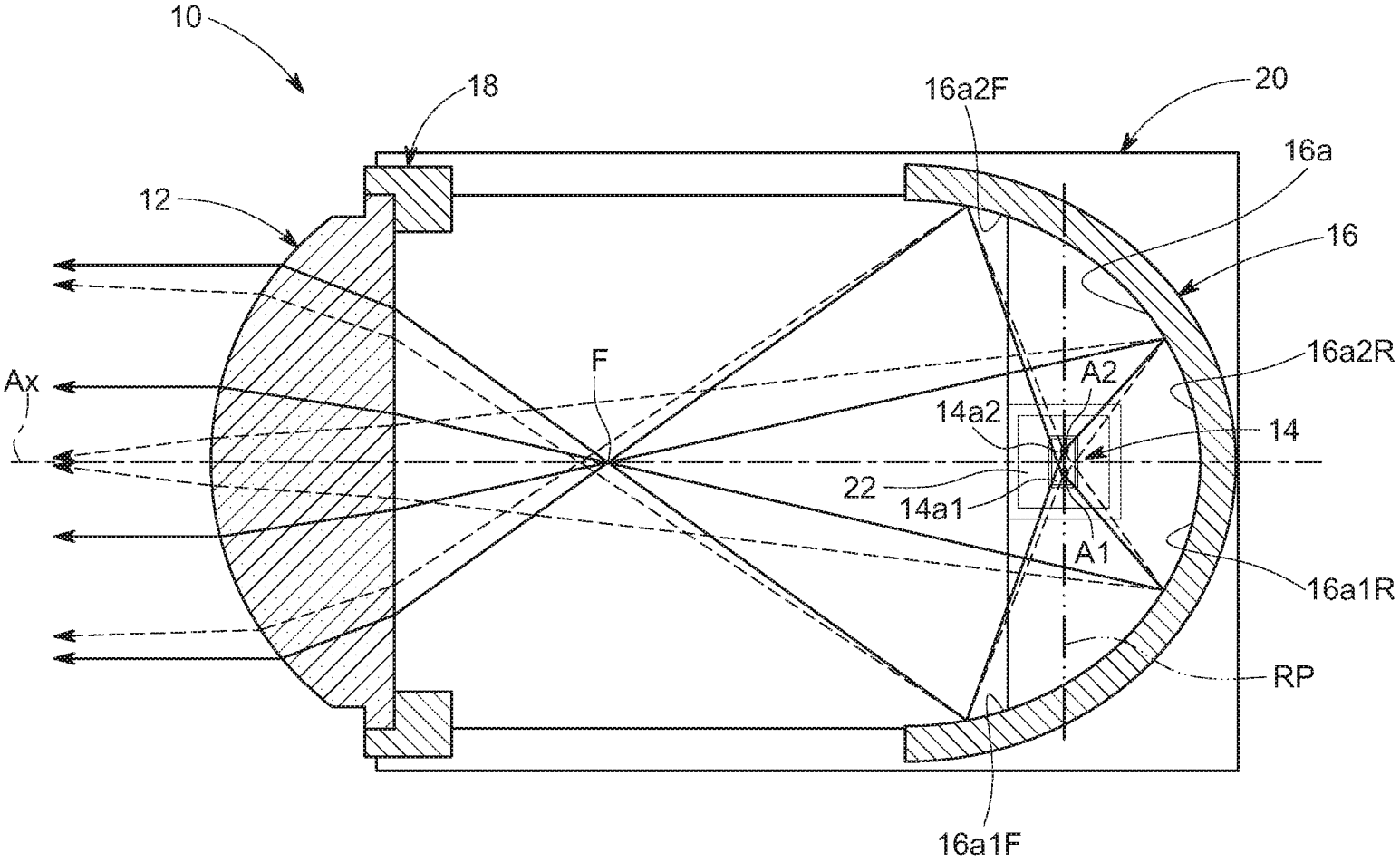
FIG. 2 is a cross-sectional taken along II-II line in FIG. 1.

FIG. 1 is a cross-sectional view of a vehicle lamp 10 according to an embodiment of the present invention, and FIG. 2 is a cross-sectional view taken along II-II line of FIG. 1.

As shown in FIGS. 1 and 2, the vehicle lamp 10 according to the present embodiment is a projector type lamp unit incorporated as a part of a head lamp and configured to form a horizontally elongated spot-shaped light distribution pattern as a part of a high-beam light distribution pattern.

That is, the vehicle lamp 10 includes a projection lens 12, a light emitting diode 14 disposed on a rear side of a rear focal point F of the projection lens 12, a reflector 16 disposed to cover the light emitting diode 14 from the top and configured to reflect light emitted from the light emitting diode 14 toward the projection lens 12.

The light emitting diode 14 is supported by a base member 20 functioning as a heat sink via a substrate 22, the projection lens 12 is supported by the base member 20 via a lens holder 18, and the reflector 16 is supported by the base member 20 at a lower end edge thereof.

The projection lens 12 is a plano-convex aspherical lens having a convex front surface and a flat rear surface and is supported by the lens holder 18 at an outer peripheral flange portion thereof. The projection lens 12 is supported by the lens holder 18 such that an optical axis Ax thereof is disposed to extend in a front-rear direction of the lamp.

The light emitting diode 14 is a white light emitting diode and includes first and second light emitting chips 14*a*1, 14*a*2 disposed adjacent to each other in a lateral direction, and the light emitting diodes 14*a*1, 14*a*2 together form a horizontally elongated rectangular light emitting surface.

Figures 3A, 3B:
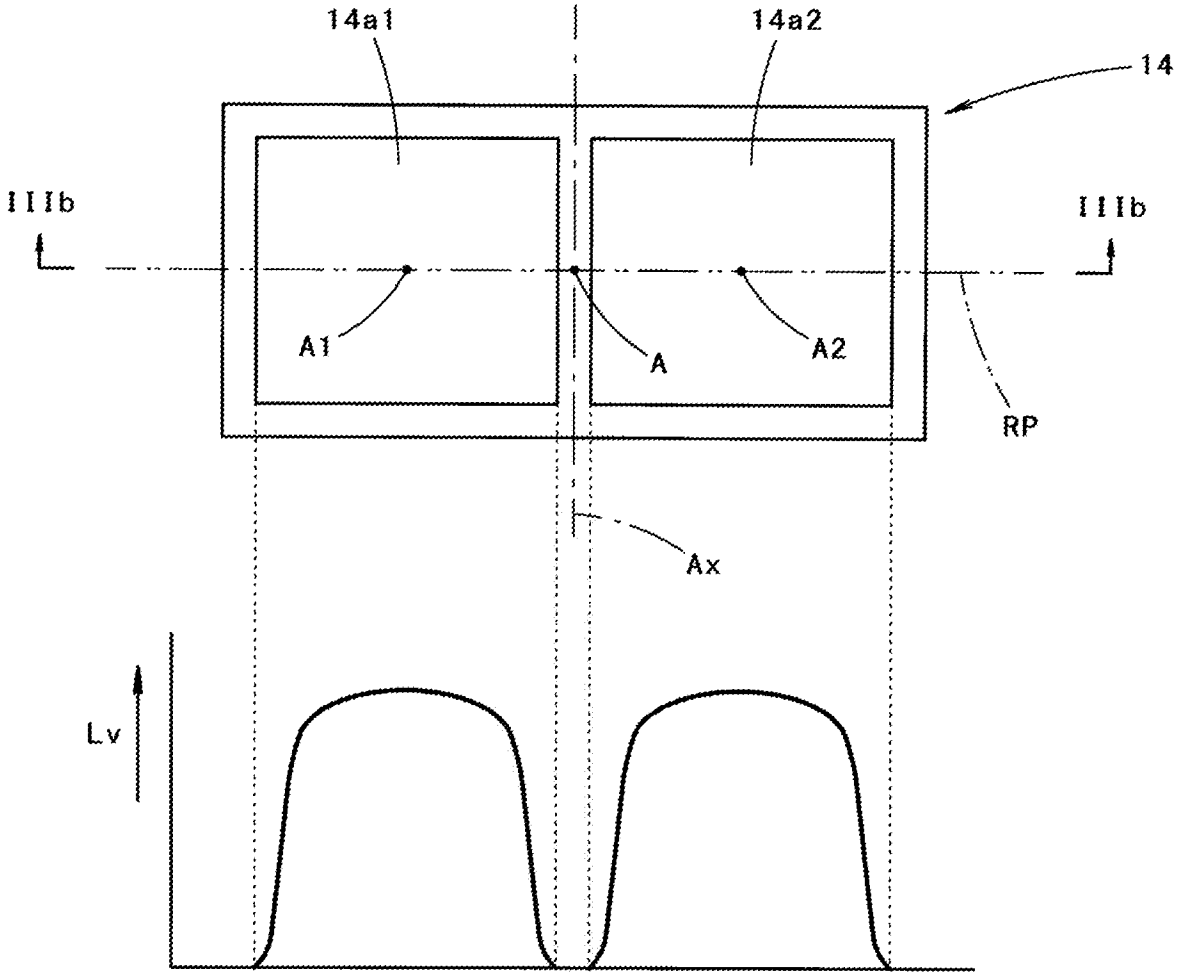
FIG. 3A is a plan view showing a light emitting diode of the vehicle lamp.
FIG. 3B is a view showing luminance distribution of first and second light emitting chips configuring the light emitting diode.

FIG. 3A is a plan view showing the light emitting diode 14, which is taken out.

As shown in FIG. 3A, a pair of left and right, first and second light emitting chips 14*a*1, 14*a*2 configuring the light emitting diode 14 each have a horizontally elongated rectangular light emitting surface which is nearly a square shape. The first and second light emitting chips 14*a*1, 14*a*2 are disposed with a space therebetween in a positional relationship of bilateral symmetry with respect to the optical axis Ax of the projection lens 12.

The light emitting diode 14 is disposed such that the first and second light emitting chips 14*a*1, 14*a*2 are directed upward at a position almost the same height as the optical axis Ax.

FIG. 3B shows the luminance distribution of the first and second light emitting chips 14*a*1, 14*a*2 at a cross section of line IIIb-IIIb of FIG. 3A. The position of cross-section line shown by a two-dot chain line is set to the position of the vertical plane perpendicular to the optical axis Ax including light emitting centers A1, A2 of the first and second light emitting chips 14*a*1, 14*a*2 (hereinafter referred to as "vertical reference plane RP").

As shown in FIG. 3B, in the luminance distributions of the first and second light emitting chips 14*a*1, 14*a*2, the luminance Lv decreases with distance from the light emitting centers A1 and A2 in the lateral direction and sharply decreases at both left and right edge portions.

As shown in FIG. 1, the reflecting surface 16*a* of the reflector 16 has an elliptical shape, wherein a light emitting center A of an entire light emitting surface of the light emitting diode 14 in a vertical cross-section including the optical axis Ax (that is, in FIG. 3A, a midpoint of the two light emitting centers A1 and A2 located on the optical axis Ax) is set as a first focal point, and the rear focal point F of the projection lens 12 is set as a second focal point.

As shown in FIG. 2, the reflecting surface 16*a* of the reflector 16 is divided into four reflecting areas in a plan view.

That is, the reflecting surface 16*a* is divided into a left rear area 16*a*1R located on the left side of the optical axis Ax and the rear side of the first and second light emitting chips 14*a*1, 14*a*2, a right rear area 16*a*2R located on the right side of the optical axis Ax and the rear side of the first and second light emitting chips 14*a*1, 14*a*2, a left front area 16*a*1F located on the left side of the optical axis Ax and the front side of the first and second light emitting chips 14*a*1, 14*a*2, and a right front area 16*a*2F located on the right side of the optical axis Ax and the front side of the first and second light emitting chips 14*a*1, 14*a*2.

Specifically, the left rear area 16*a*1R and the right front area 16*a*2F have reflecting surface shapes which are configured to reflect light emitted from the first light emitting chip 14*a*1 to converge to the rear focal point F of the projection lens 12 at a higher convergence degree than light emitted from the second light emitting chip 14*a*2. The right rear area 16*a*2R and the left front area 16*a*1F have reflecting surface shapes which are configured to reflect light emitted from the second light emitting chip 14*a*2 to converge to the rear focal point F of the projection lens 12 at a higher convergence degree than light emitted from the first light emitting chip 14*a*1.

Specifically, the left rear area 16*a*1R and the right front area 16*a*2F have the reflecting surface shape substantially along an elliptical surface with the light emitting center A1 of the first light emitting chip 14*a*1 as a first focal point and the rear focal point F of the projection lens 12 as a second focal point. The right rear area 16*a*2R and the left front area 16*a*1F have the reflecting surface shapes substantially along an elliptical surface with the light emitting center A2 of the second light emitting chip 14*a*2 as a first focal point and the rear focal point F of the projection lens 12 as a second focal point.

The reflecting surface 16*a* of the reflector 16 is formed such that the left rear area 16*a*1R and the right rear area 16*a*2R are extended frontward to the position of the vertical reference plane RP, and the left front area 16*a*1F and the right front area 16*a*2F are extended rearward to the position of the vertical reference plane RP. The reflecting surface 16*a* is formed such that the left rear area 16*a*1R and the left front area 16*a*1F are continuously formed at the position of the vertical reference plane RP, and the right rear area 16*a*2R and the right front area 16*a*2F are continuously formed at the position of the vertical reference plane RP.

Further, the reflecting surface 16*a* is formed such that the left rear area 16*a*1R and the right rear area 16*a*2R are continuously formed at the position of the vertical plane which includes the optical axis Ax. The reflecting surface 16*a* is formed such that the left front area 16*a*1F and the right front area 16*a*2F are continuously formed at the position of the vertical plane which includes the optical axis Ax.

Figure 4A:
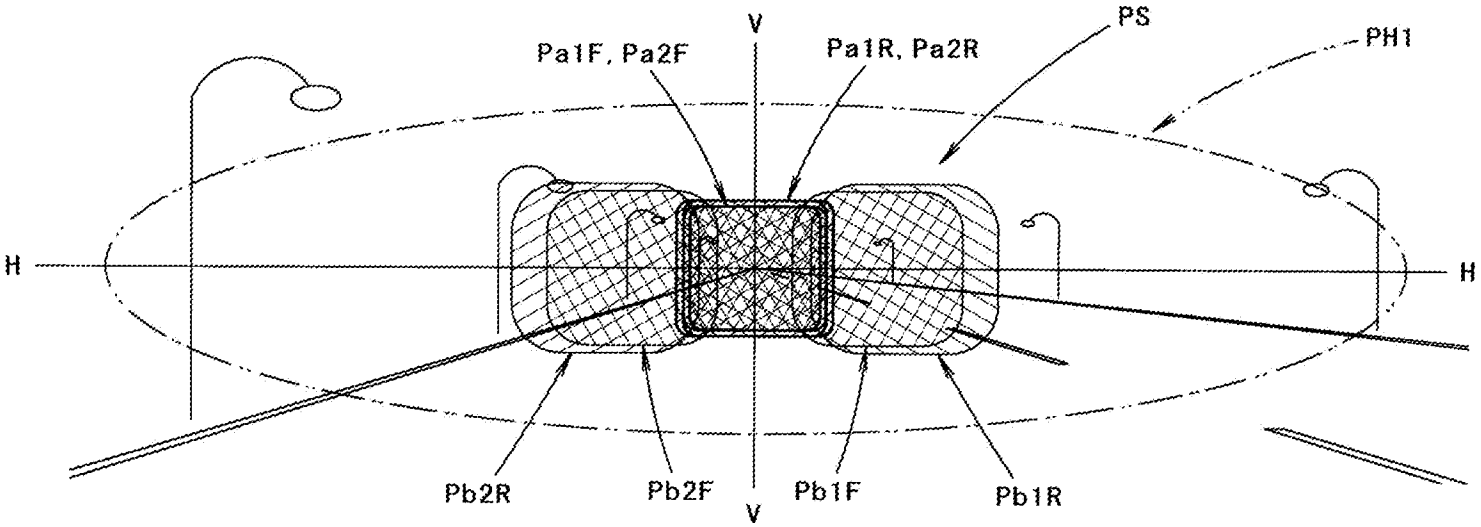
FIG. 4A is a perspective view of a light distribution pattern formed by illumination light from the vehicle lamp.

FIG. 4A is a perspective view showing a light distribution pattern PS formed on a virtual vertical screen disposed at a position 25*m* ahead of the vehicle by light illuminated forward from the vehicle lamp 10.

The light distribution pattern PS is a spot-shaped light distribution pattern formed as a part of the high-beam light distribution pattern PH1 indicated by a two-dot chain line in FIG. 4A and formed to extend horizontally with H-V, which is a vanishing point in the front direction of the lamp, at a center thereof.

The high-beam distribution pattern PH1 is formed as a combined light distribution pattern of the light distribution pattern PS and a light distribution pattern formed by illuminated light from another vehicle lamp (not shown).

The light distribution pattern PS is formed by projecting a light source image of the light emitting diode 14 onto the virtual vertical screen as an inverted projection image, wherein the light source image is formed on the rear focal plane of the projection lens 12 by the light emitted from the light emitting diode 14 and reflected by the reflector 16. As the light emitting surface of the light emitting diode 14 is configured by the first and second light emitting chips 14*a*1, 14*a*2, the light distribution pattern PS is formed by the projection images of the first and second light emitting chips 14*a*1, 14*a*2.

Since the reflecting surface 16*a* of the reflector 16 is divided into four reflecting areas, the projection images of the first and second light emitting chips 14*a*1, 14*a*2 are formed for each reflecting area.

Figure 5:
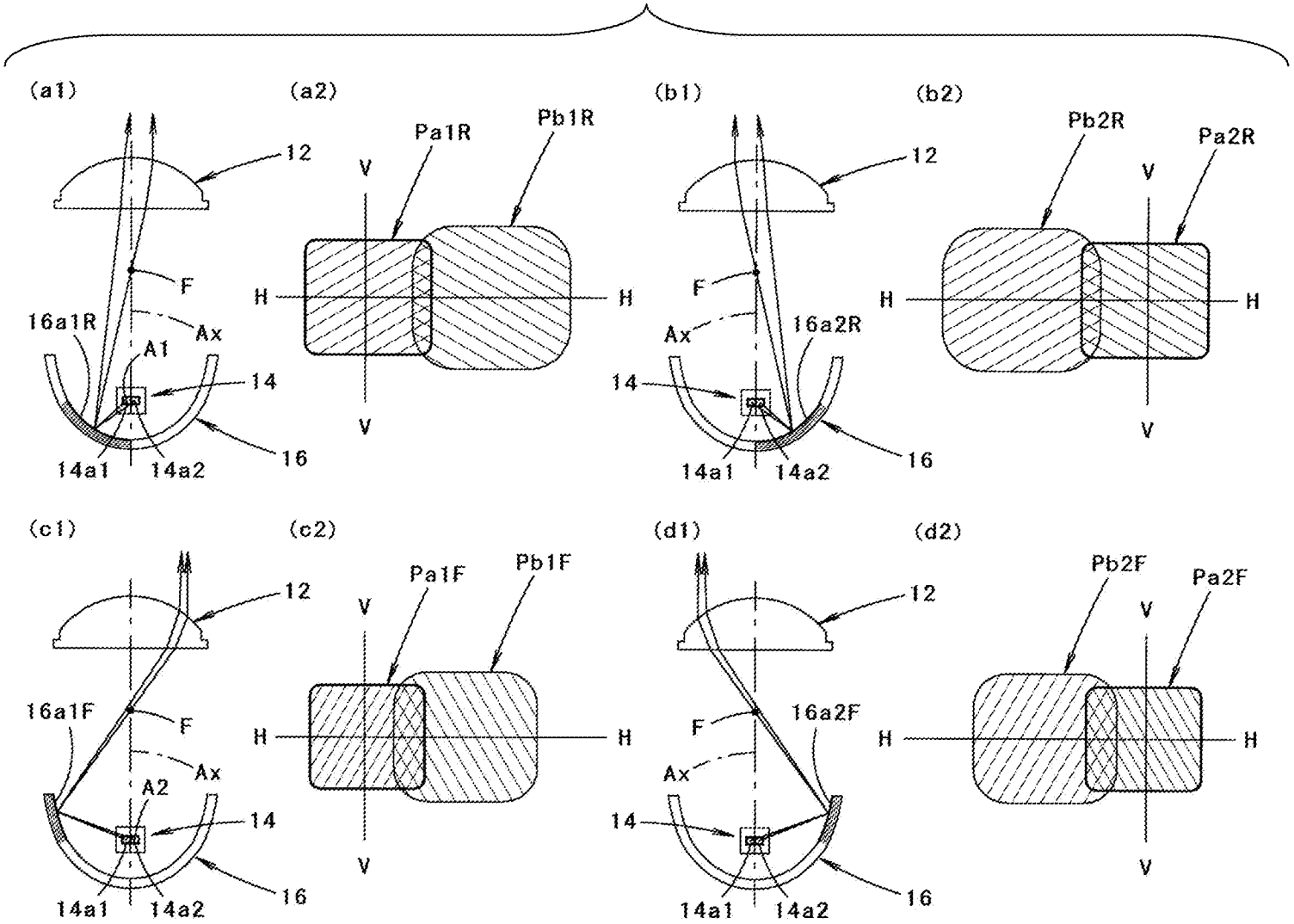
FIG. 5 is a view showing light distribution patterns formed by illumination light from the vehicle lamp while being separated by the four reflection areas of the reflector.

FIG. 5 is a diagram showing the light distribution pattern PS in separated form for each of the four reflection areas.

(a2) of FIG. 5 shows light distribution patterns Pa1R, Pb1R formed by reflected light from the left rear area 16*a*1R shown in (a1) of FIG. 5.

The light distribution pattern Pa1R is a light distribution pattern formed as a projection image of the first light emitting chip 14*a*1.

The left rear area 16*a*1R having the reflecting surface shape substantially along the elliptical surface with the light emitting center A1 of the first light emitting chip 14*a*1 as the first focal point and the rear focal point F of the projection lens 12 as the second focal point, the light emitted from the first light emitting chip 14*a*1 and reflected by the left rear area 16*a*1R passes near the rear focal point F of the projection lens 12. Accordingly, the light distribution pattern Pa1R is formed as a small and bright light distribution pattern centered on H-V.

The light distribution pattern Pb1R is a light distribution pattern formed as a projection image of the second light emitting chip 14*a*2.

The light emitted from the second light emitting chip 14*a*2 and reflected by the left rear area 16*a*1R passes through the left side of the rear focal point F of the projection lens 12. Accordingly, the light distribution pattern Pb1R is formed as a light distribution pattern which is larger and less bright compared to the light distribution pattern Pa1R at a position shifted to the right from H-V, and the left end portion of the light distribution pattern Pb1R overlaps with the right end portion of the light distribution pattern Pa1R.

(b2) of FIG. 5 is a diagram showing light distribution patterns Pa2R, Pb2R formed by the reflected light from the right rear area 16*a*2R shown in (b1) of FIG. 5.

The light distribution pattern Pa2R is a light distribution pattern formed as a projection image of the second light emitting chip 14*a*2 and the light distribution pattern Pb2R is a light distribution pattern formed as a projection image of the first light emitting chip 14*a*1.

Since the first and second light emitting chips 14*a*1, 14*a*2 are disposed symmetrically with respect to the optical axis Ax, and the right rear area 16*a*2R and the left rear area 16*a*1R are disposed symmetrically with respect to the optical axis Ax, the light distribution patterns Pa2R, Pb2R and Pa1R, Pb1R are formed symmetrically with respect to the V-V line which is a vertical line passing through H-V.

(c2) of FIG. 5 shows light distribution patterns Pa1F, Pb1F formed by the reflected light from the left front area 16*a*1F shown in (c1) of FIG. 5.

The light distribution pattern Pa1F is a light distribution pattern formed as a projection image of the second light emitting chip 14*a*2.

The left front area 16*a*1F having the reflecting surface shape substantially along the elliptical surface with the light emitting center A2 of the second light emitting chip 14*a*2 as the first focal point and the rear focal point F of the projection lens 12 as the second focal point, the light emitted from the second light emitting chip 14*a*2 and reflected by the left front area 16*a*1F passes near the rear focal point F of the projection lens 12. Consequently, the light distribution pattern Pa1F is formed as a small and bright light distribution pattern centered on H-V.

The distance from the second light emitting chip 14*a*2 to the left front area 16*a*1F is longer than the distance from the first light emitting chip 14*a*1 to the left rear area 16*a*1R, the light distribution pattern Pa1F is formed slightly brighter and smaller than the light pattern Pa1R shown in (a2) of FIG. 5.

The light distribution pattern Pb1F is a light distribution pattern formed as a projection image of the first light emitting chip 14*a*1.

The light emitted from the first light emitting chip 14*a*1 and reflected by the left front area 16*a*1F passes through the left side of the rear focal point F of the projection lens 12. Accordingly, the light distribution pattern Pb1F is formed as a light distribution pattern which is larger and less bright compared to the light distribution pattern Pa1F at a position shifted to the right from H-V, and the left end portion of the light distribution pattern Pb1F overlaps with the right end portion of the light distribution pattern Pa1F.

The light distribution pattern Pb1F is formed as a light distribution pattern slightly brighter and smaller than the light distribution pattern Pb1R shown in (a2) of FIG. 5.

(d2) of FIG. 5 shows the light distribution patterns Pa2F, Pb2F formed by the reflected light from the right front area 16*a*2F shown in (d1) of FIG. 5.

The light distribution pattern Pa2F is a light distribution pattern formed as a projection image of the first light emitting chip 14*a*1, and the light distribution pattern Pb2F is a light distribution pattern formed as a projection image of the second light emitting chip 14*a*2.

Since the first and second light emitting chips 14*a*1, 14*a*2 are disposed symmetrically with respect to the optical axis Ax, and the right front area 16*a*2F and the left front area 16*a*1F are disposed symmetrically with respect to the optical axis Ax, the light distribution patterns Pa2F, Pb2F and Pa1F, Pb1F are formed symmetrically with respect to the V-V line.

As shown in FIG. 4A, the light distribution pattern PS is formed such that four small and bright light distribution patterns Pa1R, Pb2R, Pa1F, Pb2F are formed centered on H-V, and the light distribution patterns Pa2R, Pb2F, Pb1R, Pb1F in which the brightness is reduced are formed in a partially overlapping state, so that the overall light distribution pattern formed is a horizontally elongated spot-shaped light distribution pattern, and the light distribution pattern gradually decreases in brightness toward the left and right sides.

Moreover, as the light distribution patterns Pa1F, Pb2F are slightly brighter and smaller than the light distribution patterns Pa1R, Pb2R, and the light distribution patterns Pb2F, Pb1F are slightly brighter and smaller than the light distribution patterns Pa2R, Pb1R, the light distribution pattern PS is formed as a light distribution pattern with little irregularity.

Figure 4B:
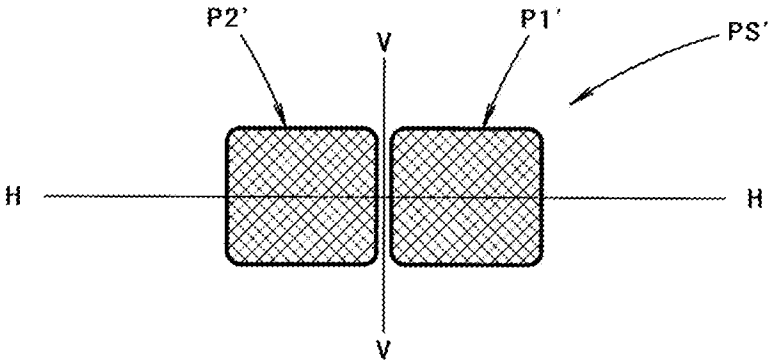
FIG. 4B is a view showing a light distribution pattern formed by illumination light from a related-art vehicle lamp.

In the meantime, FIG. 4B shows a light distribution pattern PS' formed in the case where the reflecting surface 16*a* of the reflector 16 is not divided into four reflecting areas as in the present embodiment and is formed as a single elliptical surface with the light emitting center A of the entire light emitting surface of the light emitting diode 14 as the first focal point and the real focal point F of the projection lens 12 as the second focal point.

The light distribution pattern PS' is formed as a horizontally elongated spot-shaped light distribution pattern but has light distribution patterns P1', P2' separated on both sides of the line V-V as projection images of the pair of left and right light emitting chips 14*a*1,14*a*2, and a dark portion is formed near the line V-V.

Next, the operation and effect of the above-described embodiment will be described.

Since the vehicle lamp 10 according to the above-described embodiment is configured as a projector-type vehicle lamp 10 including the light emitting diode 14 having the first (left) and second (right) light emitting chips 14*a*1, 14*a*2 and the reflector 16, the horizontally elongated spot-shaped light distribution pattern PS can be easily formed.

Further, the reflecting surface 16*a* of the reflector 16 includes the left rear area 16*a*1R and the right rear area 16*a*2R located on the rear side of the first and second light emitting chips 14*a*1, 14*a*2, and the left front area 16*a*1F and the right front area 16*a*2F located on the front side of the first and second light emitting chips 14*a*1, 14*a*2. The left rear area 16*a*1R and the right front area 16*a*2F have the reflecting surface shapes which are configured to reflect light emitted from the first light emitting chip 14*a*1 disposed on the left side to converge to the rear focal point F of the projection lens 12 at a higher convergence degree than light emitted from the second light emitting chip 14*a*2 disposed on the right side. The right rear area 16*a*2R and the left front area 16*a*1F have the reflecting surface shapes which are configured to reflect light emitted from the second light emitting chip 14*a*2 to converge to the rear focal point F of the projection lens 12 at a higher convergence degree than light emitted from the first light emitting chip 14*a*1. Accordingly, the following operation and effect can be obtained.

That is, since the light distribution patterns Pa1R, Pa2F are formed as the projection images of the first light emitting chip 14a1 at the position in front of the lamp by the reflected light from the left rear area 16a1R and the right front area 16a2F, and the light distribution patterns Pa2R, Pa1F are formed as the projection images of the second light emitting chip 14a2 at the position in front of the lamp by the reflected light from the right rear area 16a2R and the left front area 16a1F, it is possible to form the horizontally elongated spot-shaped light distribution pattern PS as a light distribution pattern whose center position in the lateral direction is bright. Therefore, long-distance visibility can be improved.

In the meantime, the reflected light from the left rear area 16a1R forms the light distribution pattern Pb1R as the projection image of the second light emitting chip 14a2 on the right side of the light distribution pattern Pa1R, the reflected light from the right front area 16a2F forms the light distribution pattern Pb2F as the projection image of the second light emitting chip 14a2 on the left side of the light distribution pattern Pa2F, the reflected light from the right rear area 16a2R forms the light distribution pattern Pb2R as the projection image of the first light emitting chip 14a1 on the left side of the light distribution pattern Pa2R, and the reflected light from the left front area 16a1F forms the light distribution pattern Pb1F as the projection image of the first light emitting chip 14a1 on the right side of the light distribution pattern Pa1F. Therefore, a horizontally elongated spot-shaped light distribution pattern can be formed in which the brightness gradually decreases toward the left and right sides.

As described above, according to the above-described embodiment, in the projector-type vehicle lamp 10 including the reflector 16, a horizontally elongated light distribution pattern PS can be formed with excellent long-distance visibility.

In the above-described embodiment, the left rear area 16a1R and the right front area 16a2F have the reflecting surface shapes substantially along the elliptical surface with the light emitting center A1 of the first light emitting chip 14a1 as the first focal point and the rear focal point F of the projection lens 12 as the second focal point. The right rear area 16a2R and the left front area 16a1F have the reflecting surface shapes substantially along the elliptical surface with the light emitting center A2 of the second light emitting chip 14a2 as the first focal point and the rear focal point F of the projection lens 12 as the second focal point. Accordingly, the horizontally elongated spot-shaped light distribution pattern PS can be formed as a light distribution pattern whose center position in the lateral direction is highly bright, so that long-distance visibility can be further improved.

Moreover, in the above-described embodiment, in the position of the vertical reference plane RP, the left rear area 16a1R and left front area 16a1F are continuously formed, and right rear area 16a2R and right front area 16a2F are continuously formed. Therefore, the utilization efficiency of the light emitted from the first and second light emitting chips 14a1, 14a2 can be improved.

In the above-described embodiment, the left rear area 16a1R and the right rear area 16a2R are extended frontward to the position of the vertical reference plane RP, and the left front area 16a1F and the right front area 16a2F are extended rearward to the position of the vertical reference plane RP. However, the left front area 16a1F and right front area 16a2F, and the left rear area 16a1R and right rear area 16a2R, may be separated from each other respectively at the front and rear sides of the first and second light emitting chips 14a1, 14a2.

In the above-described embodiment, the first and second light emitting chips 14a1, 14a2 are arranged symmetrically with respect to the optical axis Ax. However, the first and second light emitting chips 14a1, 14a2 may be arranged asymmetrically with respect to the optical axis Ax.

In the above-described embodiment, the left rear area 16a1R and left front area 16a1F, and the right rear area 16a2R and right front area 16a2F have the reflecting surface shapes which are symmetrical with respect to the optical axis Ax. However, the reflecting surface shapes may be asymmetrical with respect to the optical axis Ax.

Next, a modified embodiment of the present invention will be described.

Figure 6:
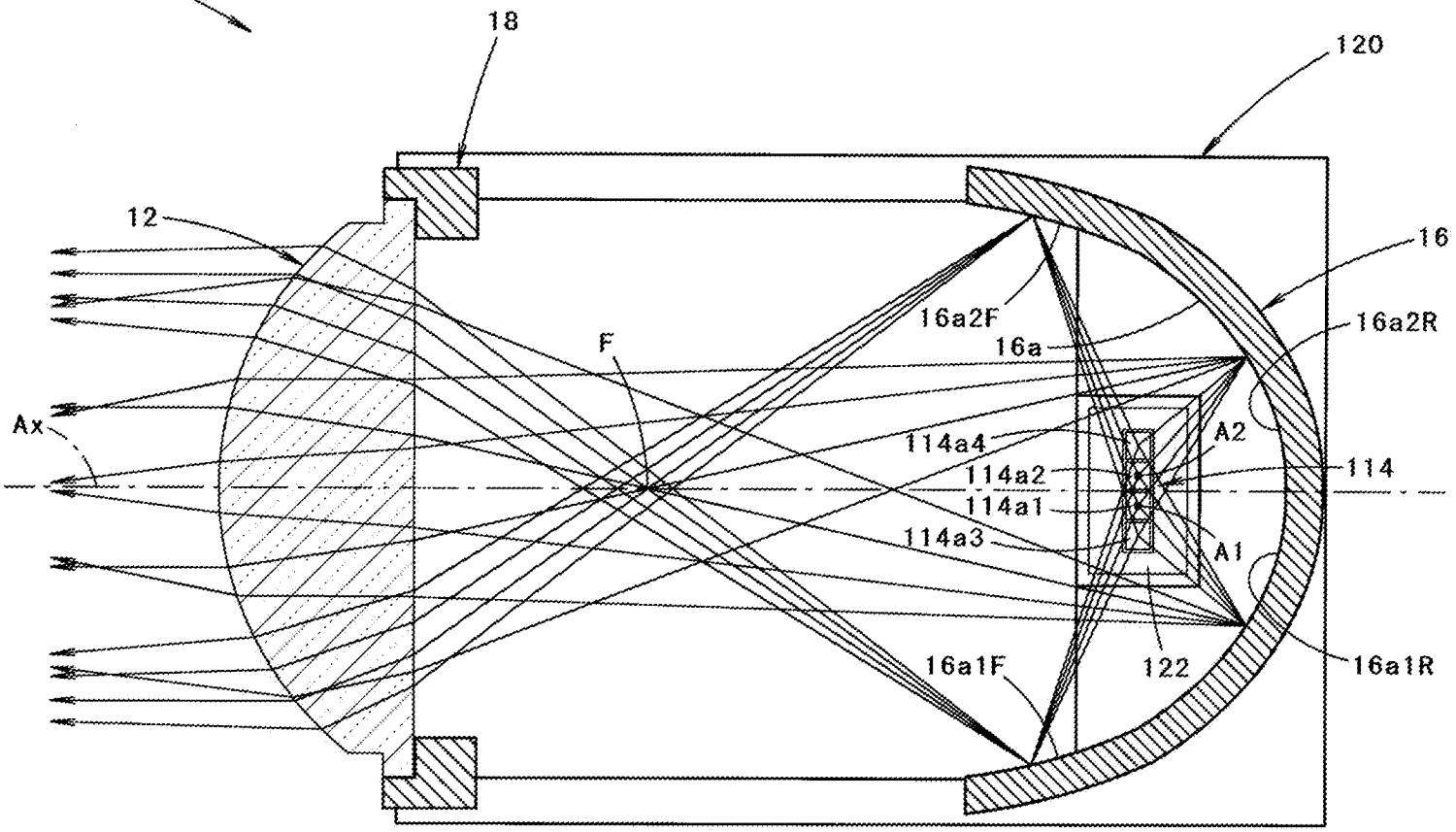
FIG. 6 is a view similar to FIG. 2 showing a modified embodiment.

FIG. 6 shows a view similar to FIG. 2 of a vehicle lamp 110 according to the modified embodiment.

As shown in FIG. 6, the vehicle lamp 110 according to the modified embodiment is similar to the above-described embodiment in the basic configuration, and the configuration of a light emitting diode 114 is different from that of the above-described embodiment.

That is, the light emitting diode 114 of the modified modification includes first and second light emitting chips 114a1, 114a2, which have the same configuration as the light emitting diode 14 of the above-described embodiment, and third and fourth light emitting chips 114a3, 114a4 are additionally disposed on the left and right sides thereof.

The third and fourth light emitting chips 114a3, 114a4 have the same configuration as the first and second light emitting chips 114A1, 114a2 and are arranged at equally spaced gaps from the first and second light emitting chips 114A1, 114a2.

In this modified embodiment, the structure of a substrate 122 and a base member 120 supporting the light emitting diode 114 is partially different from the above-described embodiment.

Figure 7:
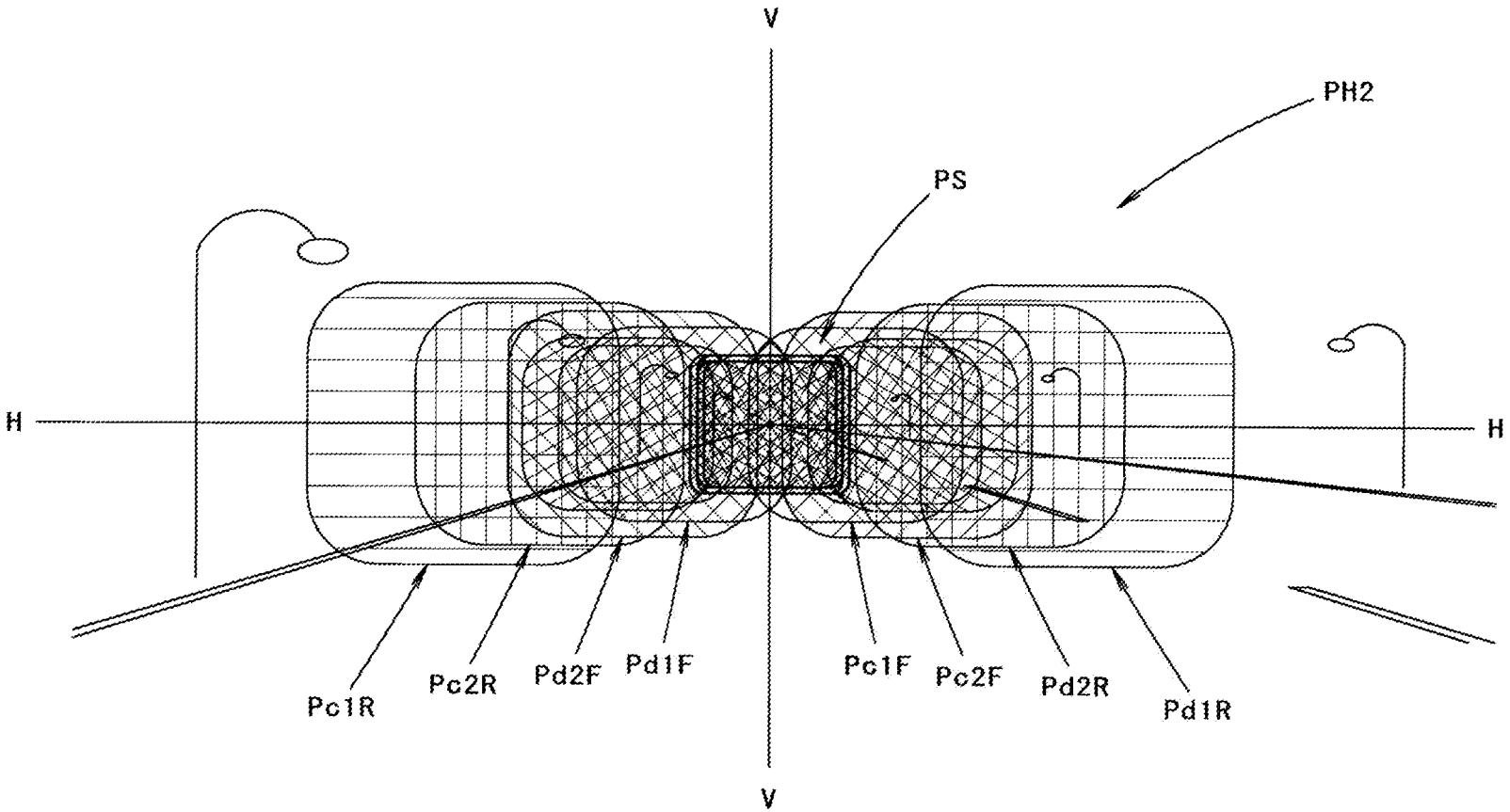
FIG. 7 is a view similar to FIG. 4A showing operation of the modified embodiment.

FIG. 7 is a perspective view of a high-beam light distribution pattern PH2 formed on a virtual vertical screen by light illuminated forward from the vehicle lamp 110.

In this high-beam light distribution pattern PH2, compared with the light distribution pattern PS formed in the above-described embodiment, eight light distribution patterns Pd1F, Pd2F, Pc2R, Pc1R, Pc1F, Pc2F, Pd2R, Pd1R are overlapped to form a light distribution pattern which is horizontally longer than the light distribution pattern PS.

The light distribution pattern Pd1F is a distribution pattern formed by light emitted from the fourth light emitting chip 14a4 and reflected by the left front area 16a1F. The light distribution pattern Pc1F is a distribution pattern formed by light emitted from the third light emitting chip 14a3 and reflected by the right front area 16a2F.

The light distribution pattern Pd2F is a distribution pattern formed by light emitted from the fourth light emitting chip 14a4 and reflected by the right front area 16a2F. The light distribution pattern Pc2F is a distribution pattern formed by light emitted from the third light emitting chip 14a3 and reflected by the left front area 16a1F.

The light distribution pattern Pc2R is a distribution pattern formed by light emitted from the third light emitting chip 14a3 and reflected by the left rear area 16a1R. The light distribution pattern Pd2R is a distribution pattern formed by light emitted from the fourth light emitting chip 14a4 and reflected by the right rear area 16a2R.

The light distribution pattern Pc1R is a distribution pattern formed by light emitted from the third light emitting chip 14a3 and reflected by the right rear area 16a2R. The light distribution pattern Pd1R is a distribution pattern formed by light emitted from the fourth light emitting chip 14*a*4 and reflected by the left rear area 16*a*1R.

In the eight light distribution patterns Pd1F, Pd2F, Pc2R, Pc1R, Pc1F, Pc2F, Pd2R, Pd1R, the four light distribution patterns Pd1F, Pd2F, Pc2R, Pc1R are formed on the left side of the line V-V, and the four light distribution patterns Pc1F, Pc2F, Pd2R, Pd1R are formed on the right side of the line V-V.

The four light distribution patterns Pd1F, Pd2F, Pc2R, Pc1R are formed in this order leftward from the line V-V while being partially overlapped with each other. The four light distribution patterns Pc1F, Pc2F, Pd2R, Pd1R are formed in this order rightward from the line V-V while being partially overlapped with each other. Further, the light distribution pattern Pd1F and the light distribution pattern Pc1F are partially overlapped at the position of line V-V.

According to the modified embodiment, the horizontally long spot light distribution pattern PS of the above-described embodiment can be further expanded to the left and right sides, and a high-beam light distribution pattern PH2 can be formed as a horizontally elongated light distribution pattern which is smoother in intensity.

Further, the high-beam light distribution pattern PH2 may be formed as a part of a high-beam light distribution pattern rather than as a high-beam light distribution pattern itself.

Also, instead of the light emitting diodes 114 of the modified embodiment, a light emitting diode may be employed which further include additional light emitting chips on both left and right sides of the third and fourth light emitting chips 114*a*3, 114*a*4. According to this configuration, it is possible to form a high-beam light distribution pattern spreading larger to the left and right sides than the high-beam distribution pattern PH2.

Incidentally, numerical values shown as specifications in the above-described embodiment and the modified embodiments are merely exemplary, and those may be set to appropriately different values.

Although the present invention has been described based on the embodiment and modified embodiments, those merely show the principle and application of the present invention. Various changes of modifications and configurations may be made in the embodiments without departing from the inventive concept as defined in the claims.

What is claimed is:

1. A vehicle lamp comprising:

a projection lens;

a light emitting diode disposed on a rear side of a rear focal point of the projection lens; and a reflector configured to reflect light emitted from the light emitting diode toward the projection lens;

wherein the light emitting diode includes a first light emitting chip disposed on a left side with respect to an optical axis of the projection lens, and a second light emitting chip disposed on a right side with respect to the optical axis of the projection lens, wherein the reflector includes a reflecting surface, the reflecting surface including:

a left rear area located on a left side of the optical axis and a rear side of the first and second light emitting chips;

a right rear area located on a right side of the optical axis and the rear side of the first and second light emitting chips;

a left front area located on the left side of the optical axis and a front side of the first and second light emitting chips; and a right front area located on the right side of the optical axis and the front side of the first and second light emitting chips, wherein the left rear area and the right front area have reflecting surface shapes which are configured to reflect light emitted from the first light emitting chip to converge to the rear focal point of the projection lens at a higher convergence degree than light emitted from the second light emitting chip that is also reflected by the left rear area and the right front area of the reflecting surface, and wherein the right rear area and the left front area have reflecting surface shapes which are configured to reflect light emitted from the second light emitting chip to converge to the rear focal point of the projection lens at a higher convergence degree than light emitted from the first light emitting chip that is also reflected by the right rear area and the left front area of the reflecting surface.

2. The vehicle lamp according to claim 1, wherein the left rear area and the right front area have the reflecting surface shapes substantially along an elliptical surface with a light emitting center of the first light emitting chip as a first focal point and the rear focal point of the projection lens as a second focal point, and wherein the right rear area and the left front area have the reflecting surface shapes substantially along an elliptical surface with a light emitting center of the second light emitting chip as a first focal point and the rear focal point of the projection lens as the second focal point.

3. The vehicle lamp according to claim 1, wherein in the reflecting surface of the reflector, the left rear area and the left front area are continuously formed, and the right rear area and the right front area are continuously formed.

4. The vehicle lamp according to claim 1, wherein at least one additional light emitting chip is respectively disposed at a left side and a right side of the first and second light emitting chips.

* * * * *